US009149142B2

(12) United States Patent
Kao

(10) Patent No.: US 9,149,142 B2
(45) Date of Patent: Oct. 6, 2015

(54) VERTICAL CURTAIN RAIL ASSEMBLY

(71) Applicant: UNI-SOLEIL ENT. CO. LTD., Tainan (TW)

(72) Inventor: Yu-Ting Kao, Tainan (TW)

(73) Assignee: Uni-Soleil Ent. Co., Ltd., Tainan (TW)

( * ) Notice: Subject to any disclaimer, the term of this patent is extended or adjusted under 35 U.S.C. 154(b) by 0 days.

(21) Appl. No.: 14/248,405

(22) Filed: Apr. 9, 2014

(65) Prior Publication Data

US 2015/0136721 A1 May 21, 2015

(30) Foreign Application Priority Data

Nov. 19, 2013 (TW) ..... 102221598 U

(51) Int. Cl.
*A47H 1/04* (2006.01)

(52) U.S. Cl.
CPC ..... *A47H 1/04* (2013.01)

(58) Field of Classification Search
CPC ..... A47H 1/04; A47H 1/10; A47H 1/14; A47H 11/00; A47H 11/02; A47H 11/06; A47H 15/02; A47H 2001/042; A47H 5/02; A47H 5/03; A47H 5/032; A47H 5/08; A47H 5/14
USPC ..... 211/162; 160/345, 346; 16/87.4 R, 95 R
See application file for complete search history.

(56) References Cited

U.S. PATENT DOCUMENTS

| | | | | | |
|---|---|---|---|---|---|
| 3,155,148 | A | * | 11/1964 | Kenney | 160/344 |
| 3,192,996 | A | * | 7/1965 | Greenstadt et al. | 160/345 |
| 3,503,434 | A | * | 3/1970 | Ford | 160/345 |
| 3,881,219 | A | * | 5/1975 | Haarer | 16/94 D |
| 3,951,197 | A | * | 4/1976 | Cohen et al. | 160/346 |
| 4,381,812 | A | * | 5/1983 | Ford et al. | 160/172 R |
| 6,138,324 | A | * | 10/2000 | Lin | 16/87.6 R |

FOREIGN PATENT DOCUMENTS

| | | | | | |
|---|---|---|---|---|---|
| DE | 9301904 | U1 | * | 2/1993 | A47H 11/06 |
| FR | 1025095 | A | * | 8/1950 | A47H 1/12 |
| FR | 2050655 | A5 | * | 6/1969 | A47H 5/032 |
| FR | 2109194 | A5 | * | 10/1970 | A47H 11/06 |
| GB | 1393890 | A | * | 5/1975 | A47H 1/04 |

* cited by examiner

*Primary Examiner* — Joshua Rodden
(74) *Attorney, Agent, or Firm* — Rosenberg, Klein & Lee

(57) ABSTRACT

A vertical curtain rail assembly is revealed. The vertical curtain rail assembly includes a sealing member disposed on an end of a rail. A receiving space is formed on one end of the sealing member not connected to the rail and for mounting a positioning plate of an assembling member while a protection cover of the assembling member is closed over an opening of the receiving space. The positioning plate is arranged with at least one guide wheel. Thereby a cord is wound around the guide wheel on the positioning plate of the assembling member firstly, outside the sealing member. Then the positioning plate of the assembling member disposed with the cord around the guide wheel is mounted into the receiving space and the protection cover of the assembling member is closed over the opening. Thus the cord is wound around the guide wheels conveniently and stably.

6 Claims, 6 Drawing Sheets

VERTICAL CURTAIN RAIL ASSEMBLY

FIELD OF THE INVENTION

The present invention relates to a vertical curtain rail assembly, especially to a vertical curtain rail assembly in which a cord and guide wheels at end parts of a rail are wound around and assembled with each other conveniently and stably.

DESCRIPTIONS OF RELATED ART

Refer to FIG. 5, a sealing member 71 on each of two ends of a rail 7 for vertical curtains available now is revealed. A guide wheel 72 and a positioning part 73 for fixing the guide wheel 72 inside the sealing member 71 are mounted in the sealing member 71. Thus there is a limited space inside the sealing member 71. When a user intends to wind a cord around the guide wheel 72, a tool such as a hook is required to draw the string inside the sealing member 71. This is quite inconvenient.

In order to solve the problem, refer to FIG. 6, an opening 82 is mounted over a sealing member 81 on each of two ends of a rail 8. The opening 82 is communicating with a space inside the sealing member 81. A groove 83 is molded on a wall surface of each of two sides of the space inside the sealing member 81. Two ends of a shaft 85 of a guide wheel 84 are mounted into and positioned by the grooves 83 respectively. When the user intends to wind a cord around the guide wheel 84, the cord is firstly wound around the guide wheel 84 outside the sealing member 81. Then the guide wheel 84 with the cord is mounted into the sealing member 81 through the opening 82 thereabove. And the two ends of the shaft 85 are positioned in the grooves 83 on two side walls of the sealing member 81. Although such design improves the convenience in assembling of the guide wheel 84 with the cord, the guide wheel is easy to fall off from the sealing member 81 through the opening 82 during package or transportation process. Moreover, the guide wheels 84 are installed vertically. The cord needs to be turned into a horizontal direction while entering the rail 8. The operation is not so smooth.

SUMMARY OF THE INVENTION

Therefore it is a primary object of the present invention to provide a vertical curtain rail assembly in which a cord is wound around guide wheels at end parts of a rail conveniently and stably.

In order to achieve the above object, a vertical curtain rail assembly of the present invention includes a sealing member disposed on each end part of a rail. One end of the sealing member opposite to the end thereof connected to the rail is arranged with a receiving space for receiving a positioning plate of an assembling member while a protection cover of the assembling member is closed over an opening of the receiving space of the sealing member. The positioning plate is disposed with at least one guide wheel.

Thereby a cord is wound around the guide wheel on the positioning plate of the assembling member in advance, outside the sealing member, before setting the guide wheel and the cord into the rail. Then the positioning plate of the assembling member disposed with the cord wound around the guide wheel is mounted into the receiving space of the sealing member and the protection cover of the assembling member is closed over the opening of the receiving space Thus the cord is wound around the guide wheels conveniently and firmly.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
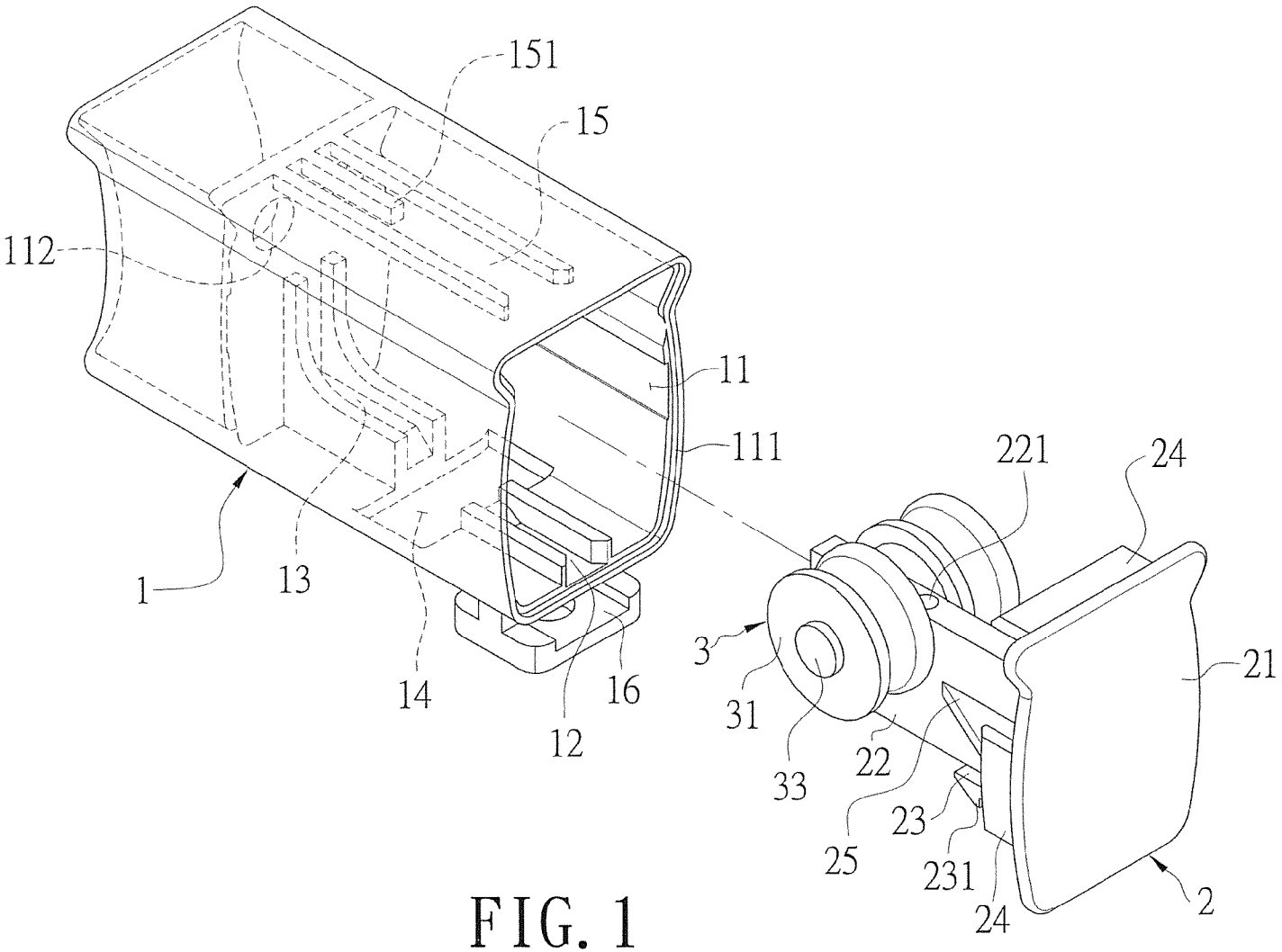
FIG. 1 is an explosive view of an embodiment according to the present invention.
Figure 2:
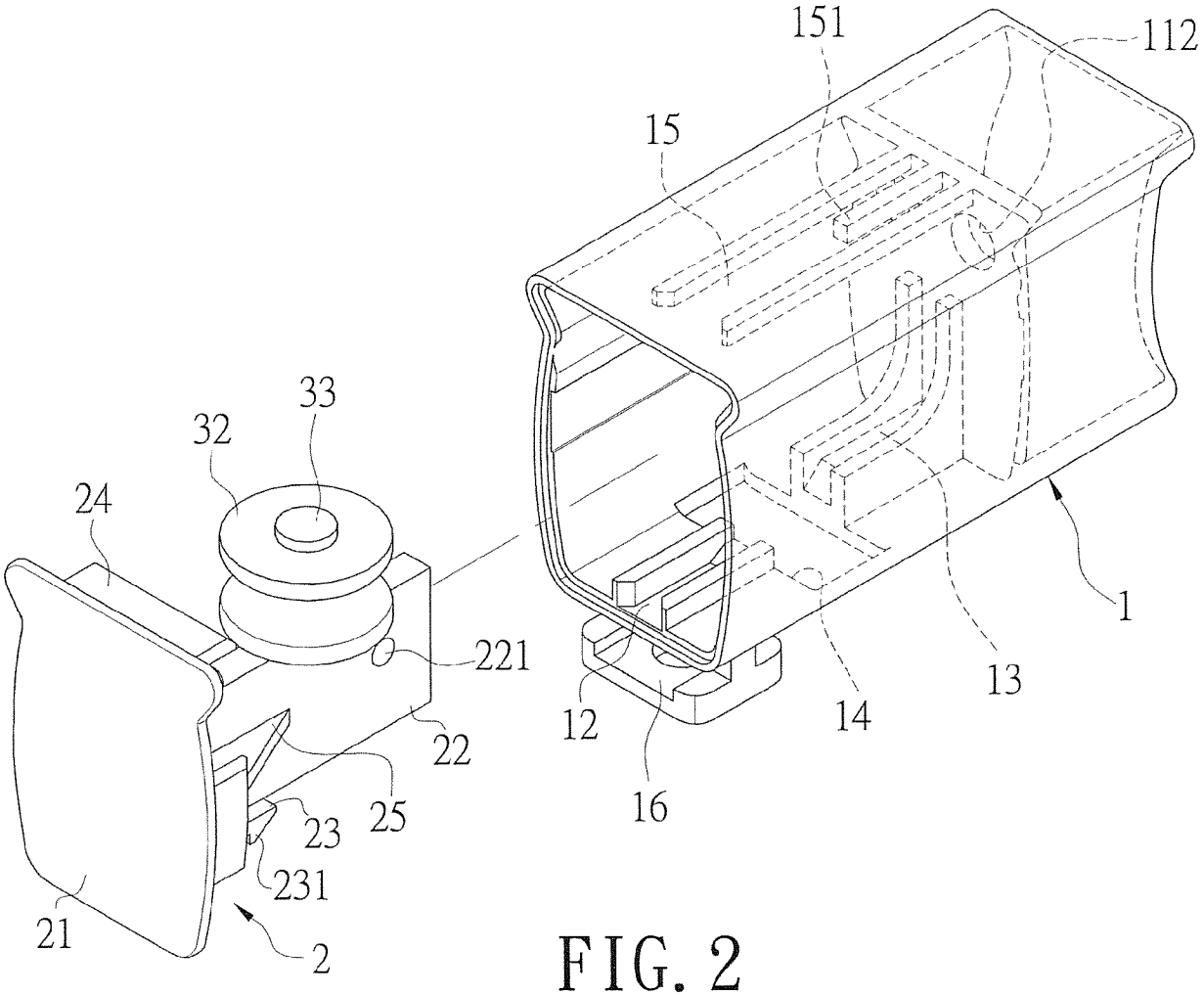
FIG. 2 is another explosive view of an embodiment according to the present invention.
Figure 3:
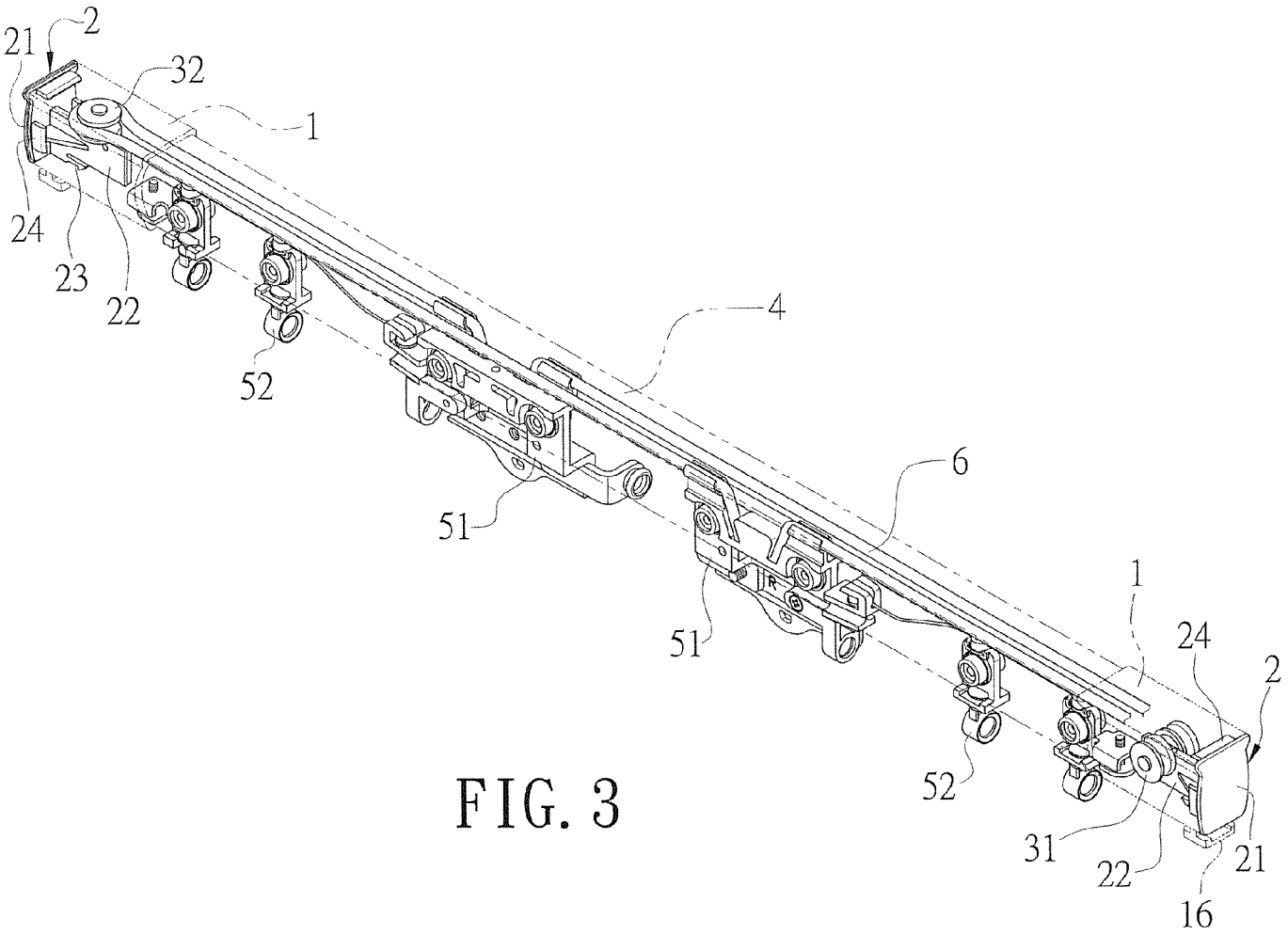
FIG. 3 is a perspective view of an embodiment according to the present invention.
Figure 4:
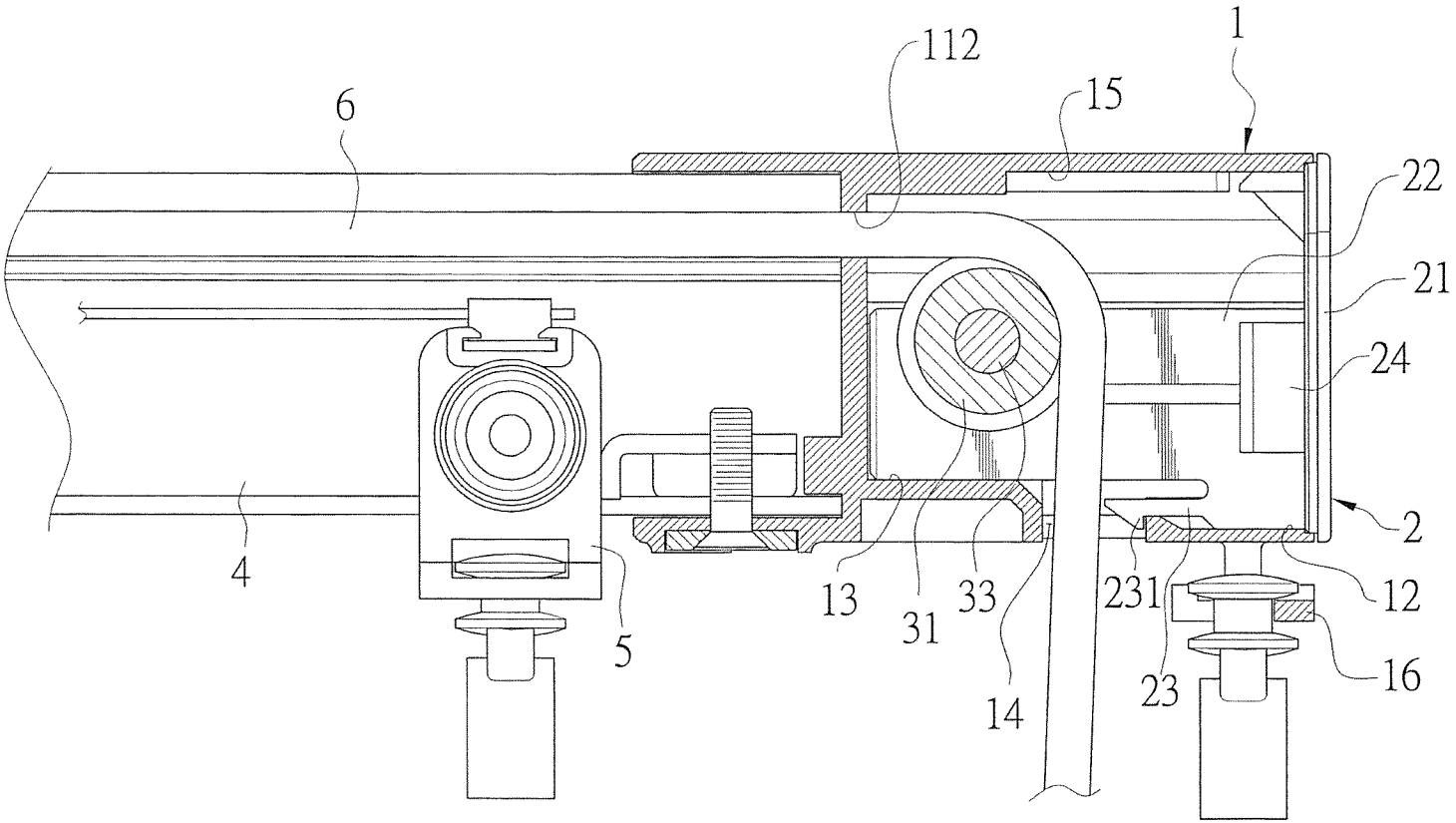
FIG. 4 is a cross sectional view of an embodiment according to the present invention.
Figure 5:
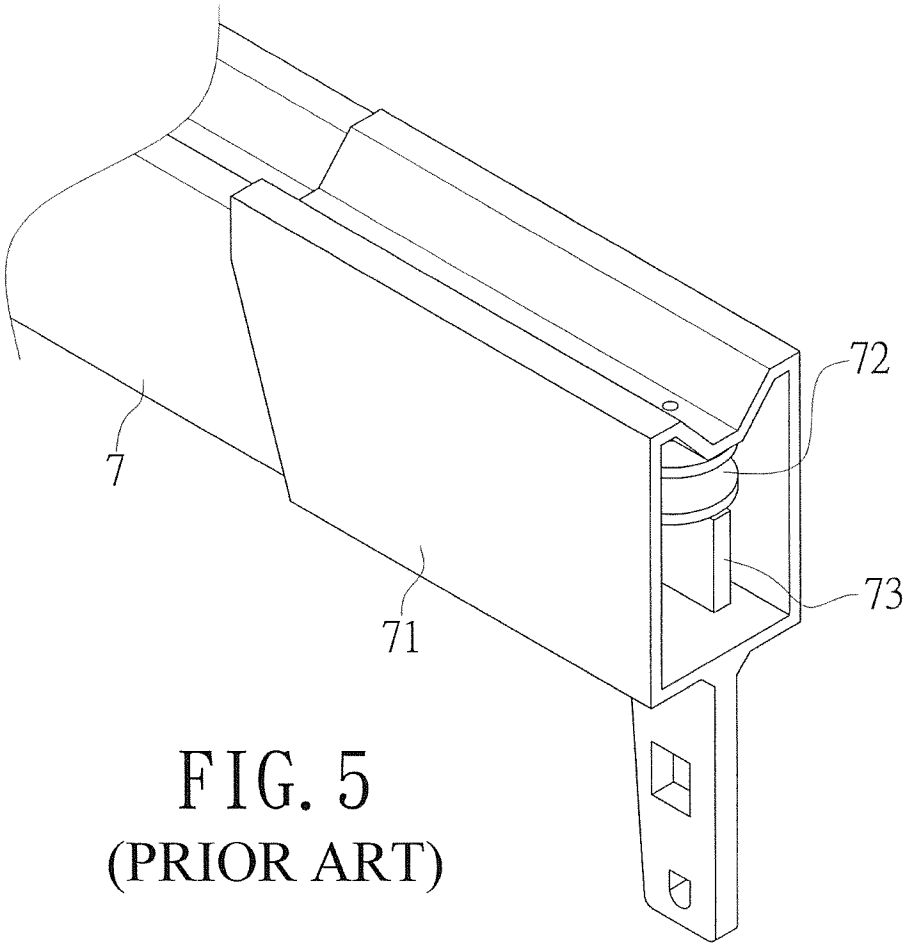
FIG. 5 (PRIOR ART)
FIG. 5 is a perspective view of a prior art.
Figure 6:
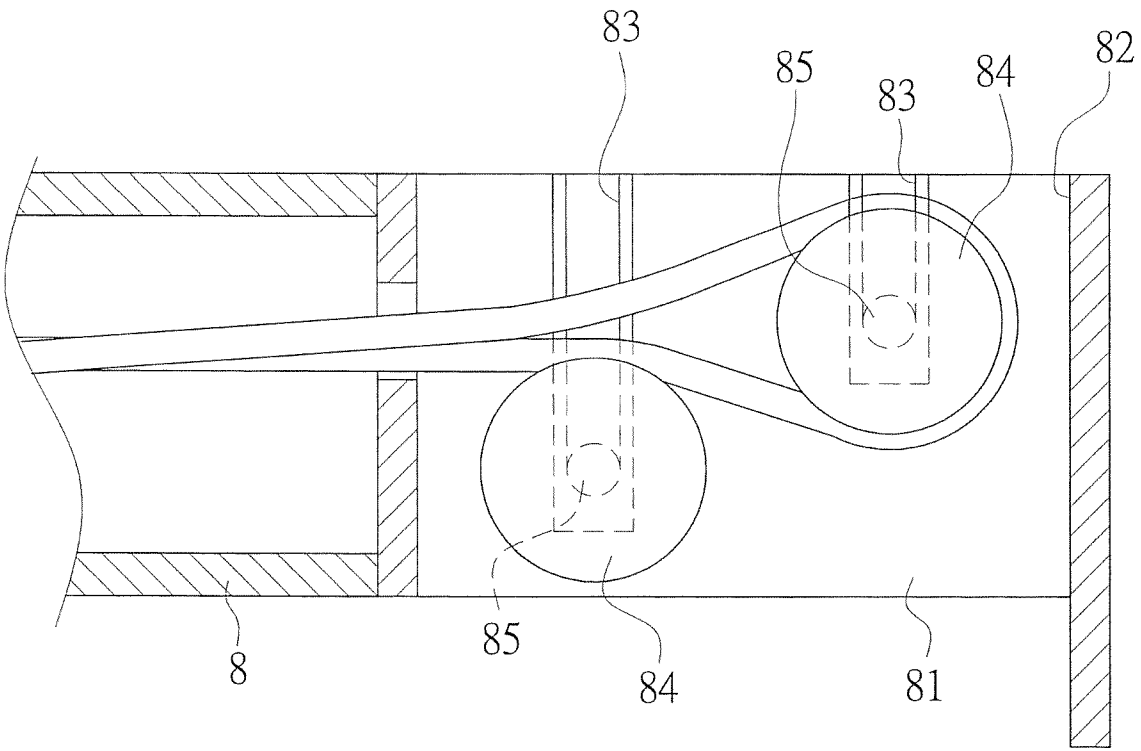
FIG. 6 (PRIOR ART)
FIG. 6 is a cross sectional view of a prior art.

Refer to FIG. 1, FIG. 2 and FIG. 3, a rail assembly for curtains is composed of sealing members 1, assembling members 2 and guide wheels 3.

One end of the sealing member 1 is connected to an end part of a rail 4 while a molded receiving space 11 is formed on the other end of the sealing member 1. A cord hole 112 is formed on one side of the receiving space 11 adjacent to the rail 4 while a first positioning slot 12 and a second positioning slot 13 are arranged in turn at a bottom wall of the receiving space 11 from an opening 111 of the receiving space 11 toward an inner space of receiving space 11. A through hole 14 is disposed between the first positioning slot 12 and the second positioning slot 13. The height of a bottom side of the second positioning slot 13 is higher than the height of a bottom side of the first positioning slot 12. A third positioning slot 15 is set on a top wall of the receiving space 11 and corresponding to the first positioning slot 12 as well as the second positioning slot 13. A stopping strip 151 is disposed in the third positioning slot 15. A hanging part 16 is formed on an outer surface of the bottom side of the sealing member 1.

The assembling member 2 is connected to one end of the sealing member 1 opposite to the end of the sealing member 1 connected to the rail 4. The assembling member 2 consists of a protection cover 21, a positioning plate 22, a fastening block 23, leaning supporting pieces 24, and a reinforcement rib 25. The protection cover 12 is for covering over the opening 111 of the receiving space 11 of the sealing member 1. The positioning plate 22 is extended horizontally from an inner surface of the protection cover 21 while the fastening block 23 is also extended horizontally from the inner surface of the protection cover 21 and is located under the positioning plate 22. There is a certain distance between the positioning plate 22 and the fastening block 23. A hook portion 231 is formed on a front end of the fastening block 23. The other end of the positioning plate 22, opposite to the end thereof connected to the protection cover 21 is aligned with and mounted into the second positioning slot 13 of the sealing member 1. As to the fastening block 23 under the positioning plate 22, it is mated with the first positioning slot 12. The hook portion 231 of the fastening block 23 is hooked with and positioned by the through hole 14 between the first positioning slot 12 and the second positioning slot 13. The leaning supporting piece 24 is formed on a left side, a right side, and a top side of the inner surface of the protection cover 21 respectively so as to lean against two side walls and a wall on top of the receiving space 11 of the sealing member 1 for fixing. Moreover, a shaft hole 221 is formed on side surfaces or an upper edge of the positioning plate 22. The reinforcement rib 25 is formed on inner surface of the protection cover 21 and connected to both the positioning plate 22 and the leaning supporting piece 24.

The guide wheel 3 can be a horizontal guide wheel 31 or a vertical guide wheel 32. Refer to FIG. 1, the horizontal guide wheel 31 is located on each of two sides of the positioning plate 22 of the assembling member 2 while a shaft 33 is inserted through a center thereof, connected to, and fixed by the shaft hole 221 on the side surface of the positioning plate 22. As to the vertical guide wheel 32, as shown in FIG. 2, it is located at a top edge of the positioning plate 22 of the assembling member 2 while a shaft 33 is inserted through a center thereof, connected to, and fixed by the shaft hole 221 on the top edge of the positioning plate 22. A top end of the shaft 33 of the vertical guide wheel 32 is mounted in and positioned by the third positioning slot 15 on top of the receiving space 11 of the sealing member 1.

Refer from FIG. 1 to FIG. 4, a plurality of main sliding parts 51, carriers 52 and a cord 6 are mounted into the rail 4 in turn. Two ends of the cord 6 are respectively inserted through the cord hole 112 of the sealing member 1 on each of two sides of the rail 4 and drown into the receiving space 11 of the sealing member 1. Two assembling members 2 are respectively assembled with the horizontal guide wheels 31 and the vertical guide wheel 32 so as to form one assembling member 2 that includes two horizontal guide wheels 31 respectively arranged at each of two sides of the positioning plate 22, and the other assembling member 2 that includes one vertical guide wheel 32 disposed on the top edge of the positioning plate 22.

Then the cord 6 in the receiving space 11 of the sealing member 1 is wound around the vertical guide wheel 32 on the assembling member 2 so as to connect the assembling member 2 having the vertical guide wheel 32 to the corresponding sealing member 1. When the assembling member 2 is arranged into the sealing member 1, the positioning plate 22 of the assembling member 2 is guided and mounted into the second positioning slot 13 of the sealing member 1. While the bottom edge of the positioning plate 22 being in contact with the second positioning slot 13, one end of the shaft 33 of the vertical guide wheel 32 disposed on the top edge of the positioning plate 22 is guided by and mounted in the third positioning slot 15 over the receiving space 11. Along with the movement of the assembling member 2, the fastening block 23 on the rear part of the positioning plate 22 is moved and mounted into the first positioning slot 12. And the hook portion 231 at one end of the fastening block 23 is hooked with and positioned by the through hole 14. The leaning supporting pieces 24 on the two side walls and the top wall of the protection cover 21 are respectively against the two side walls and the top wall of the receiving space 11 of the sealing member 1 and fixed thereby. The protection cover 21 is closed over the opening 111 of the receiving space 11 of the sealing member 1. One end of the shaft 33 inserted through and connected to the upper edge of the positioning plate 22 is also against and positioned by the stopping strip 151 in the third positioning slot 15. Thus the assembling member 2, the vertical guide wheel 32 and one end of the cord 6 wound around the vertical guide wheel 32 are disposed stably in the sealing member 1. The sealing member 1 assembled with the assembling member 2 and one end of the cord 6 is sleeved on one end of the rail 4.

Next the cord 6 of the sealing member 1 on the other end of the rail 4 is wound around the horizontal guide wheels 31 on two sides of the positioning plate 22 of the other assembling member 2. Two single strings of the cord 6 are wound around the horizontal guide wheels 31 and then the assembling member 2 arranged with the horizontal guide wheels 31 is mounted into the corresponding sealing member 1. The opening 111 of the sealing member 1 is closed by the protection cover 21 of the assembling member 2. Thus the assembling member 2, the horizontal guide wheels 31, and the other end of the cord 6 wound around the horizontal guide wheels 31 are firmly arranged in the sealing member 1. Then this sealing member 1 is also sleeved on the other end of the rail 4 to complete the assembly of the cord 6 with the horizontal guide wheels 31 and the vertical guide wheel 32 on two ends of the rail 4. Curtain fabric is connected to the sliding parts 51 and carriers 52 while the outermost sides of the curtain fabric is attached to the carriers 52 of the hanging part 16 on the bottom of the sealing member 1. Thus the outermost sides of the fabric are stiff and smooth, covering the whole rail 4. Thus the curtain fabric looks beautiful and fascinating.

In summary, the cord 6 of the rail assembly is firstly wound around the horizontal guide wheels 31/the vertical guide wheel 32 of the assembling member 2, outside the sealing member 1. Then the assembling member 2 with the cord 6 is mounted into the receiving space 11 of the sealing member 1. The positioning plate 22 of the assembling member 2 with the horizontal guide wheels 31/the vertical guide wheel 32 is positioned by the first positioning slot 12, the second positioning slot 13, and the third positioning slot 15 of the receiving space 11 of the sealing member 1. Thus the horizontal guide wheels 31 and the vertical guide wheel 32 will not shake, run out or move while being pulled by the cord 6 wound therearound. Thus the cord 6 works stably. Moreover, the opening 111 of the receiving space 11 of the sealing member 1 is closed by the protection cover 21. Thus the horizontal guide wheels 31 and the vertical guide wheel 32 will not fall out of the sealing member 1. Furthermore, the assembly of the sealing member 1 with the assembling member 2 is suitable for each end of the rail 4. The cost of molds required is saved. The design of the present invention is more convenient and practical.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A vertical curtain rail assembly comprising sealing members and assembling members, each of said sealing members being connected to a respective one end of a rail, and each of said assembling members being mounted into a respective one end of the sealing member not connected to the rail; wherein the sealing member has a receiving space formed on the end thereof not connected to the rail, a cord hole formed on one surface of the receiving space adjacent to the rail, a first positioning slot and a second positioning slot arranged in turn at a wall surface of one side of the receiving space from an opening of the receiving space toward an inner space of the receiving space, and a through hole disposed on said wall surface of the receiving space and located between the first positioning slot and the second positioning slot; and the assembling member includes a protection cover, a positioning plate, and a fastening block; the protection cover is formed at one end of the assembling member and used for covering over the opening of the receiving space of the sealing member correspondingly; the positioning plate is extended horizontally from an inner surface of the protection cover, arranged with at least one guide wheel, and mounted in the receiving space; the fastening block is extended horizontally from the inner surface of the protection cover, located adjacent to the positioning plate and having a hook portion formed on a front end thereof; the other end of the positioning plate, opposite to the end thereof connected to the protection cover is aligned with and mounted into the second positioning slot of the sealing member while the fastening block is mated with the first positioning slot of the sealing member and the hook portion of the fastening block is hooked with and positioned by the through hole of the sealing member.

2. The assembly as claimed in claim 1, wherein a plurality of shaft holes are respectively formed on side surfaces and an upper edge of the positioning plate of the assembling member; the guide wheel is arranged either horizontally or vertically; a shaft is inserted through a center of the guide wheel to be mounted with one of the plurality of shaft holes of the positioning plate.

3. The assembly as claimed in claim 2, wherein a third positioning slot is set on a wall of the receiving space of the sealing member and corresponding to the first positioning slot as well as the second positioning slot while a stopping strip is disposed in the third positioning slot; one end of the shaft of the vertically arranged guide wheel is mounted in the third positioning slot and against the stopping strip in the third positioning slot for positioning.

4. The assembly as claimed in claim 1, wherein a leaning supporting piece is respectively formed on different sides of the inner surface of the protection cover respectively so as to lean against side walls of the receiving space of the sealing member for positioning.

5. The assembly as claimed in claim 4, wherein a plurality of shaft holes are respectively formed on side surfaces and an upper edge of the positioning plate of the assembling member; the guide wheel is arranged either horizontally or vertically; a shaft is inserted through a center of the guide wheel to be mounted with one of the plurality of shaft holes of the positioning plate.

6. The assembly as claimed in claim 5, wherein a third positioning slot is set on a wall of the receiving space of the sealing member and corresponding to the first positioning slot as well as the second positioning slot while a stopping strip is disposed in the third positioning slot; one end of the shaft of the vertically arranged guide wheel is mounted in the third positioning slot and against the stopping strip in the third positioning slot for positioning.

* * * * *